United States Patent [19]

Okamoto

[11] 4,304,197

[45] Dec. 8, 1981

[54] CONDENSATE RECOVERY SYSTEM

[75] Inventor: Masakatsu Okamoto, Kakogawa, Japan

[73] Assignee: T L V Co., Ltd., Tokyo, Japan

[21] Appl. No.: 119,953

[22] Filed: Feb. 8, 1980

[30] Foreign Application Priority Data

Mar. 23, 1979 [JP] Japan ..... 54-34653

[51] Int. Cl.[3] ..... F22D 5/26

[52] U.S. Cl. ..... 122/451 R; 122/1 C; 122/444

[58] Field of Search ..... 122/1 C, 412, 414, 415, 122/444, 451 R, 451.2, 452, 456, 406

[56] References Cited

U.S. PATENT DOCUMENTS

| | | | |
|---|---|---|---|
| 671,374 | 4/1901 | Flinn | 122/451 R |
| 1,555,435 | 9/1925 | Rohrer | 122/444 |
| 2,931,344 | 4/1960 | Stiers | 122/1 C |
| 2,932,287 | 4/1960 | Goetz | 122/451 R |
| 4,207,842 | 6/1980 | Kehlhofer | 122/451 R |

*Primary Examiner*—Henry C. Yuen

*Attorney, Agent, or Firm*—Toren, McGeady & Stanger

[57] ABSTRACT

A condensate recovery system wherein a condensate receiver is provided between a boiler and a feed water tank with condensate being introduced into the condensate receiver during a period when water is not being fed to the boiler and with water being fed into the boiler during a subsequent feeding period by pumping make-up water into the condensate receiver. The system is arranged so that equalizing the pressure of the condensate inlet port of the condensate receiver with that at the low temperature water outlet port of the condensate receiver allows condensate to flow by gravity and replace low temperature water therein, leaving the condensate receiver filled with water.

11 Claims, 5 Drawing Figures

CONDENSATE RECOVERY SYSTEM

The present invention relates generally to steam apparatus and more particularly to a system for condensate recovery in such steam apparatus. The invention relates to the type of system wherein high temperature condensate formed in the steam equipment is pumped into the boiler in order to reuse the condensate as boiler feed water and also to conserve fuel by providing the capacity for recovering a large quantity of the system heat.

Heretofore, high temperature condensate in the steam apparatus of the type to which the present invention relates has been mixed with low temperature water in a feed water tank in order to raise the temperature of the make-up water and it is then pumped into the boiler by a feed water pump. In this system, however, the water which is to be handled is limited to relatively low temperature water due to cavitation developed in the pump.

In another prior system, a circulation loop is provided between a delivery port and a suction port of a feed water pump and a jet pump composed of an ejector is interposed in the system. The jet pump serves to induce high temperature condensate and to raise the pressure at the pump suction port in order to prevent cavitation in the pump. This system, however, involves disadvantages inasmuch as difficulties arise in the selection of a jet pump which is appropriate to the feed water pump capacity and in control of the feed water pump operation in compliance with variation in the condensation rate. Furthermore, a significantly lower pump efficiency arises due to circulation of part of the delivery.

SUMMARY OF THE INVENTION

In accordance with the present invention, a condensate recovery system for steam apparatus including feed water means and boiler means is provided with a condensate receiver being located between a boiler and a feed water pump of the feed water means. The system operates with a feeding phase, during which water is fed to the boiler and with a non-feeding phase during which no water is fed to the boiler. Condensate is introduced into the condensate receiver during the non-feeding phase and condensate accumulated in the condensate receiver is fed into the boiler during a next feeding phase by pumping make-up water into the condensate receiver. Then, the feed water pump need only deliver low temperature make-up water into the condensate receiver with no fear that cavitation will occur. Furthermore, condensate, after being introduced into the condensate receiver, is fed into the boiler by pumping make-up water thereinto. Therefore, most of the heat contained in the condensate can be recovered in the boiler.

In accordance with the present invention, there is thus provided a device for introducing condensate into a condensate receiver during the non-feeding phase of the condensate recovery system, and particularly there is provided a device which is capable of introducing condensate while the condensate receiver is filled with water and which is relatively easy to operate, simple in construction and low in cost.

In the specific system of the present invention, there is also provided a condensate sub-receiver means located above the condensate receiver with condensate which is formed in the steam equipment and flash steam being initially introduced into the condensate sub-receiver means. A condensate passage is provided in order to enable condensate accumulated in the condensate sub-receiver to be transferred into the condensate receiver. Condensate valve means operate to close the condensate passage during the feeding period or phase of operation of the system and to open it during the non-feeding phase. The system also includes discharge passage means which operate to discharge low temperature water from the condensate receiver during the non-feeding phase in order to return the low temperature water to the feed water tank of the system. An intermediate part of the discharge passage means is located above the point at which the condensate passage is brought into communication with the condensate receiver. Discharge valve means are provided in order to close the discharge passage during the feeding phase and to open it during the non-feeding phase. Furthermore, an equalizing passage connects the portion of said discharge passage located downstream of the discharge valve means and above the condensate receiver side opening of the condensate passage with the steam portion of the condensate sub-receiver.

In the construction of the present invention described above, during the non-feeding phase, since both the condensate valve means and the discharge valve means are in the open position, the condensate sub-receiver, the condensate receiver, the discharge passage and the equalizing passage all communicate with each other and the level in the condensate sub-receiver which communicates with the condensate receiver will always coincide with the level in the equalizing passage which communicates with the discharge passage.

When condensate is introduced into and accumulates in the condensate sub-receiver, this condensate will flow into the upper portion of the condensate receiver through the condensate passage while lower temperature water present in the lower portion of the condensate receiver will be discharged into the discharge passage so that the two levels above described will coincide. Such replacement of lower temperature water with hot condensate is effected while the condensate receiver is filled with water because the discharge passage is located to extend upwardly higher than the condensate receiver side opening of the condensate passage. Since the equalizing passage communicates with the discharge passage at a point higher than the condensate receiver side opening of the condensate passage, the level never falls below the point of conjunction of the equalizing passage and the discharge passage and accordingly steam never enters the condensate receiver.

In this manner, condensate is introduced into and gradually accumulated in the condensate receiver only upon opening of the condensate valve and discharge valve while lower temperature water is discharged. This system, therefore, is relatively easy to operate, simple in construction and low in cost. Even if the condensate valve is closed during the feeding phase of operation of the system, condensate will be temporarily held in the condensate sub-receiver and it will be introduced into the condensate receiver during the next non-feeding period. As a result, the heat loss is very small.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENT

Figure 1:
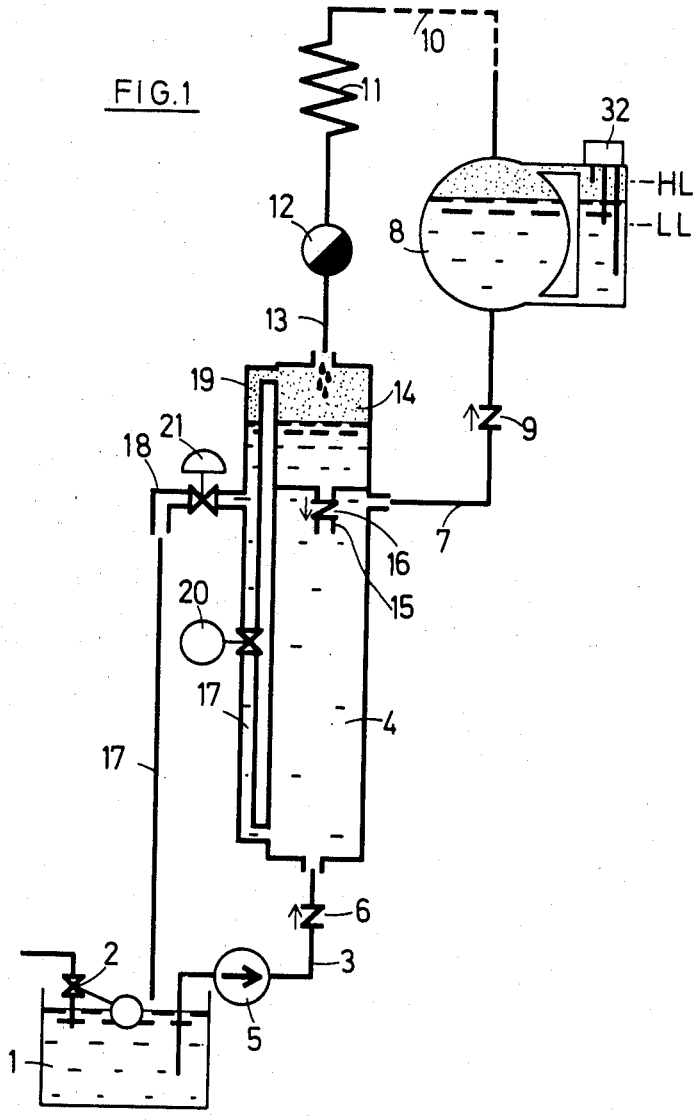
FIG. 1 is a schematic piping diagram showing an exemplary condensate recovery system in accordance with the present invention.

Referring first to FIG. 1, the system of the present invention is shown schematically as including a feed water tank 1 which is supplied with water from an appropriate source through a ball tap 2 so that the level in the tank is maintained constant. The feed water tank 1 communicates with a condensate receiver 4 at the bottom thereof through a pumping passage 3. In the pumping passage 3, a feed water pump 5 which may, for example, be of the centrifugal type, is arranged and inlet valve means comprising a check valve 6 is provided to prevent back flow from the condensate receiver 4 to the tank 1.

The upper portion of the condensate receiver 4 communicates with a boiler 8 through pumping output passage means 7. Back flow from the boiler 8 is prevented by outlet valve means comprising a check valve 9. Steam generated in the boiler 8 is conveyed through a transmission pipe 10 to steam equipment 11 and condensate formed in the steam equipment 11 is selectively discharged by a steam trap 12 and it is introduced through a condensate recovery passage 13 into a condensate sub-receiver 14.

The condensate sub-receiver 14 is located above the condensate receiver 4. Condensate accumulated in the condensate sub-receiver 14 flows by gravity into the condensate receiver 4 through condensate passage means 15. Back flow from the condensate receiver 4 to the condensate-sub receiver 14 is prevented by condensate valve means comprising a check valve 16.

Discharge passage means 17 are provided which extend upwardly from a bottom outlet port of the condensate receiver 4. The discharge passage means 17 include a horizontal passage which is located above the condensate receiver side opening where the condensate passage means 15 are brought into flow communication with the condensate receiver 4. Equalizing passage means 19 which open to the upper stream portion of the condensate sub-receiver 14 are connected in flow communication with the discharge passage means 17 at a point higher than the point where the condensate passage means 15 enter in flow communication with the condensate receiver 4.

The discharge passage means 17 includes the horizontal passage 18 and a downwardly extending pipe which extends to the feed water tank 1. An electrically operated discharge valve 20 is arranged in the discharge passage means 17 at a point upstream of the point of conjunction of the discharge passage 17 with the equalizing passage 19. Downstream of this conjunction point, a primary pressure control valve 21 is fitted in the portion of the discharge passage means 17 comprising the horizontal passage 18. The electrically operated valve 20 may be of a motorized or electromagnetic valve of a type known in the art.

Figure 4:
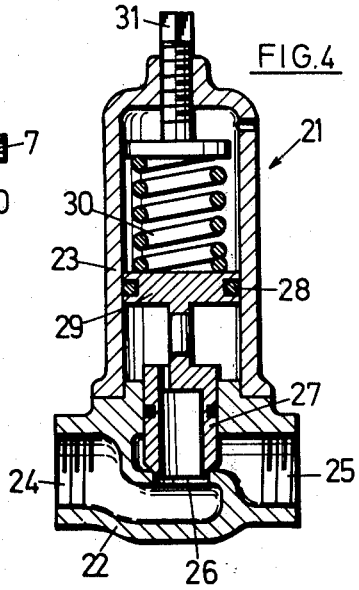
FIG. 4 is a sectional view showing an exemplary construction of a primary pressure control valve used in the system.

Referring now to FIG. 4, there is shown an example of a primary pressure control valve 21 which may be used with the system of the present invention. The valve 21 includes a casing which is composed of a casing body 22 and a cover 23 fastened together by bolts (not shown). A valve orifice 26 is defined between an inlet 24 to be connected with the primary side and an outlet 25 to be connected with the secondary side. A valve body 27 is arranged so that it is seated from the outlet side on the valve seat defining the valve orifice 26. The valve body 27 is connected by a valve rod with a piston 29 which slides in the internal cylinder of the cover 23 with a packing 28 being provided therebetween. Inlet pressure is exerted on the surface of the piston 29 on the side of the valve body 27 and a spring force created by a spring 30 is applied upon the opposite surface. The pressure at which the valve body 27 opens in order to enable flow through the valve orifice 26 may be set by turning of a threaded adjusting rod 31 which is threadedly engaged to move inwardly or outwardly of the cover 23 in order to adjust the spring force of the spring 30. Therefore, if the primary side pressure is lower than the set pressure, fluid cannot pass through the valve orifice 26 since the valve will be closed. If the primary side pressure reaches the set pressure, it will compress the spring 30 and lift the piston 29. Accordingly, the valve body 27 will become unseated from the valve seat defined at the orifice 26 and fluid flow through the orifice may occur into the outlet 25. The pressure of the primary side fluid may rise at most up to the value of the set pressure.

Referring again to FIG. 1, the higher the pressure at which the primary pressure control valve is set, so long as it does not prevent condensate discharge through the steam trap 12, the higher will be the temperature at which condensate and flash steam can be accumulated in the condensate sub-receiver 14 and the condensate receiver 4 and the larger will be the quantity of heat which can be recovered. The primary pressure control valve 21 may not be fitted.

In the system depicted and described herein, the feed water pump 5 and the electrically operated valve 20 are controlled in compliance with a signal received from a boiler level detector 32.

If the level in the boiler 8 falls below the lower level LL, the signal from the level detector 32 will cause the discharge valve 20 to close the discharge passage means 17 and the feed water pump 5 will be actuated into operation. Water in the feed water tank will be pressurized and pumped into the bottom of the condensate receiver 4 through the pumping passage 3. Condensate accumulated in the condensate receiver 4 will be pumped into the boiler 8 through the output passage means 7 and check valve 9 because the check valve 16 will prevent back flow through the condensate passage 15 into the condensate sub-receiver 14. If the condensate that has been filled in the condensate receiver 4 is insufficient for the requirements of the system, water pumped from the feed water tank 1 is also fed into the boiler 8.

When the level in the boiler 8 reaches the high level HL, a signal from the level detector 32 causes the feed water pump to become deactivated and the discharge valve 20 will open the discharge passage means 17. Pressure in the condensate receiver 4 will decrease to the set pressure of the primary pressure control valve 21. The check valve 6 prevents back flow of water from the condensate receiver 4 into the feed water input passage 3. The check valve 9 prevents back flow of high pressure water from the boiler 8 into the output passage means 7. Thus, an equal pressure will exist throughout each of the condensate sub-receiver 14, the condensate receiver 4, the discharge passage 17 and the equalizing passage 19. Therefore, equal pressure will be exerted on both levels in the condensate sub-receiver 14 and equalizing passage 19. When condensate flows into the condensate sub-receiver 14, low temperature water at the bottom of the condensate receiver 4 flows upwardly through the discharge passage means 17 and it will discharge through the horizontal passage 18 and the primary pressure control valve 21. In turn, condensate in the condensate sub-receiver 14 will flow into the condensate receiver 4 through the condensate passage 15. As a result, both levels will be maintained at a similar height. In such a manner, residual water in the condensate receiver 4 will be gradually replaced with high temperature condensate.

Due to the fact that the point of conjunction between the equalizing passage means 19 and the discharge passage 17 is located above the opening where the condensate passage 15 is placed in flow communication with the condensate receiver 4, steam will never flow into the condensate receiver 4 and the condensate receiver 4 is always filled with water.

Figure 2:
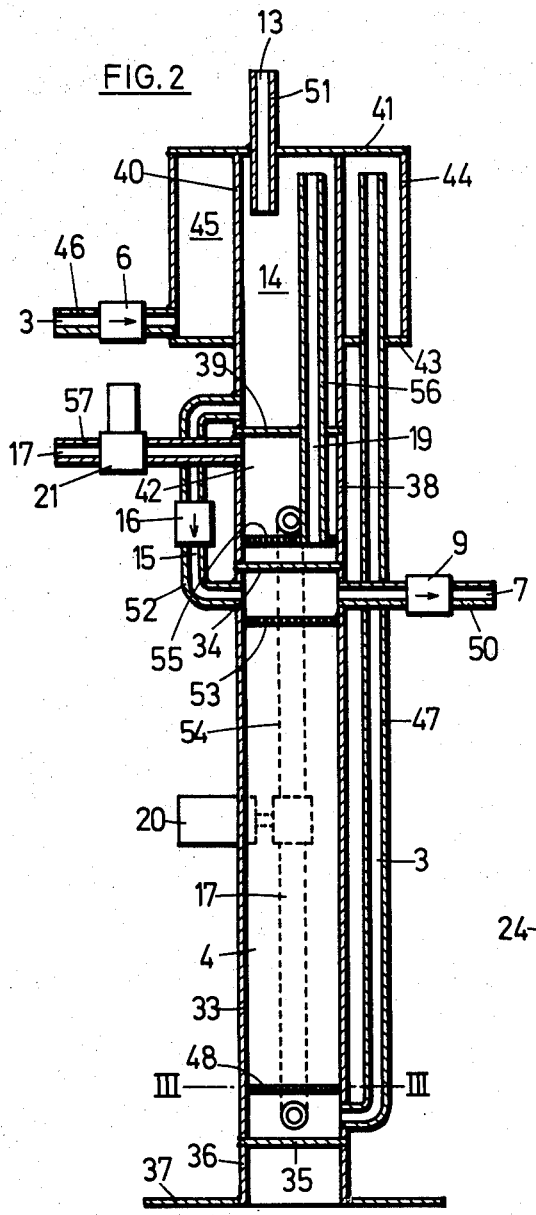
FIG. 2 is a sectional view showing in better detail parts of the condensate recovery system of the invention.

FIG. 2 indicates an example of a condensate recovery system in accordance with the present invention. The condensate receiver 4 comprises a long, vertical, cylindrical chamber consisting of a large cylindrical pipe 33 with a top end plate 34 and with a bottom end plate 35 welded at respective ends of the pipe 33. A short pipe 36 is welded to the bottom end plate 35 and a foot plate 37 is welded to the other end of the short pipe 36. On the top end plate 34, a mixing chamber 42 and the condensate sub-receiver 14 are formed by welding a short pipe 38, a partition plate 39, a pipe section 40 and a large circular cover plate 41 all arranged together in the order indicated taken in a direction upwardly of the system. A flange 43 is welded to the pipe section 40 which encloses the condensate sub-receiver 14 approximately at the center thereof. Between the flange 43 and the cover plate 41, a large short pipe 44 is inserted and welded thereto in order to constitute an annular cooling chamber 45 formed around the upper portion of the condensate sub-receiver 14. A small pipe 46 constituting part of the feed water passage means 3 is welded to the bottom of the short pipe 44 which constitutes the wall of the cooling chamber 45. Inlet valve means consisting of the check valve 6 is provided in the pipe 46. The check valve 6 permits flow only in the direction toward the cooling chamber 45, as indicated by the arrow. The cooling chamber 45 is also formed as part of the feed water means including the feed water passage 3.

Figure 3:
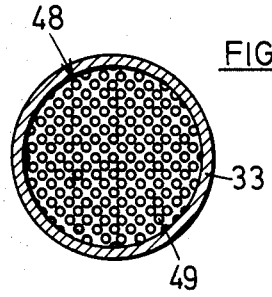
FIG. 3 is a sectional view taken along the line III—III of FIG. 2 showing a perforated plate of the system.

A small tube 47 also constituting a part of the feed water passage means 3 is installed so that one end thereof opens into the upper portion of the cooling chamber 45 and with the other end thereof opening at the bottom of the condensate receiver 4. At the lower portion of the condensate receiver 4, a perforated plate 48 is installed above the opening for the tube 47 so as to separate the interior of the condensate receiver 4. The perforated plate 48, as best seen in FIG. 3, comprises a circular plate having a number of small openings or holes 49 punched therethrough and being welded to the internal surface of the pipe 33. A small tube 50, one end of which is welded to the upper part of the pipe 33, is arranged to constitute part of the output passage means 7 including the check valve 9 comprising the outlet valve means. The check valve 9 allows flow toward the condensate receiver only as shown by the direction of the arrow.

The condensate recovery passage means 13 is formed by a small tube 51 which is fitted through the cover plate 41 with one end thereof opening into the condensate sub-receiver 14.

A small tube 52 constituting the condensate passage means 15 is installed with one end open to the lower portion of the condensate sub-receiver 14 and with its other lower end placed in flow communication with the upper portion of the condensate receiver 4.

Condensate valve means in the form of the check valve 16 are provided in the small tube 52 to allow flow from the condensate sub-receiver 14 to the condensate receiver 4 only in the direction indicated by the arrow. At the upper part of the condensate receiver 4, a perforated plate 53 is installed below the point at which the tube 52 enters into flow communication with the condensate receiver 4 in order to separate the upper portion of the condensate receiver 4. The perforated plate 53 is structured similarly to the perforated plate 48 shown in FIG. 3.

A small tube 54 constitutes part of the discharge passage means 17 and is installed so that one end thereof opens below the perforated plate 48 of the condensate receiver 4 with the other end of the tube 54 opening into the mixing chamber 42.

The discharge valve means 20 is fitted into the discharge passage means 17 in order to effect opening and closing thereof. Electrically operated valves such as an electromagnetic valve and a motorized valve are suitable for use as the discharge valve means 20.

A perforated plate 55 is installed at the lower portion of the mixing chamber 42 in order to separate the interior thereof. The perforated plate 55 is similar to the plate 48 shown in FIG. 3. A small tube 56 is provided to constitute the equalizing passage means 19 with one end thereof opened below the perforated plate 55 of the mixing chamber 42 and with its other end opening to the upper steam portion of the condensate sub-receiver 14. The mixing chamber 42 constitutes part of the discharge passage means 17. A small tube 57 also constitutes a part of the discharge passage means 17 and it is welded to the upper portion above the perforated plate 55 of the mixing chamber 42, it being provided with the primary pressure control valve 21 seen in detail in FIG. 4.

With the condensate recovery system of the present invention structured as described above, condensate in the condensate sub-receiver 14 is introduced through the condensate passage means 15 into the condensate receiver 4 and it will fall smoothly in layers through the perforated plate 53, mixing the lower temperature water in the lower portion of the condensate receiver 4 being avoided. Low temperature condensate pumped into the condensate receiver 4 during the feeding period rises also in layers through the perforated plate 48 fitted near the bottom of the condensate receiver 4, mixing with high temperature condensate in the upper portion of the condensate receiver 4 being avoided. Therefore, high temperature condensate flows out through the output passage means 7 prior to low temperature water being pumped in.

Flash steam accumulated in the upper portion of the condensate sub-receiver 14 is cooled and condensed by low temperature water in the cooling chamber 45, being also recovered. Water in the cooling chamber 45, which is heated by the heat transfer, is pumped into the condensate receiver 4 and fed into the boiler 8 during the next feeding phase. Since steam at the upper portion of the condensate sub-receiver 14 mixed with water in the mixing chamber 42 through the perforated plate 55, the mixing is carried out smoothly and without pressure variation.

Figure 5:
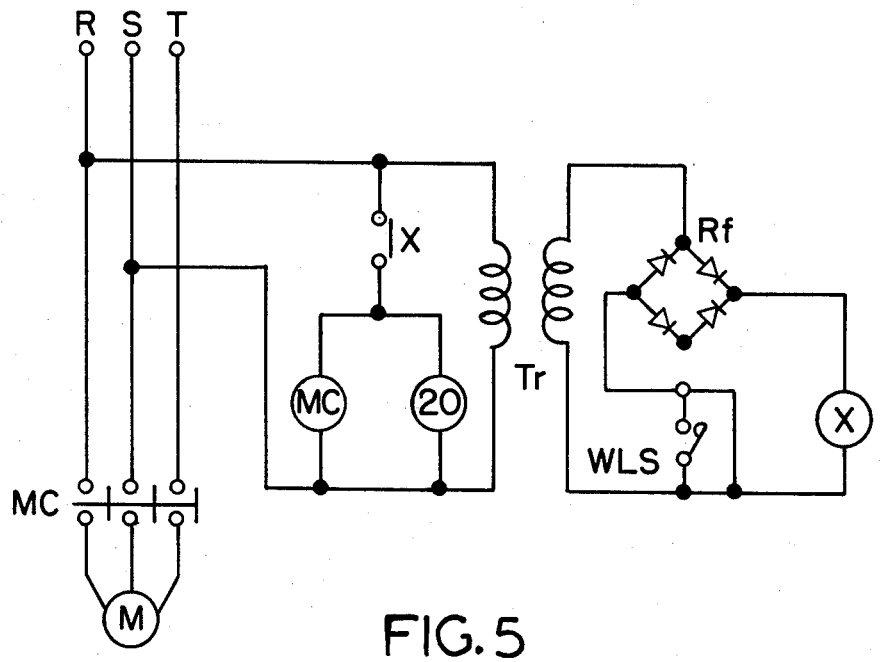
FIG. 5 is a schematic illustration of a control circuit for the system of the invention.

A control circuit for the system of the invention is shown in FIG. 5. The control circuit of FIG. 5 includes the valve 20 seen in FIGS. 1 and 2 and terminals R, S, and T are provided which are connected to a source of electrical power supply. MC indicate relays and M is an electric motor which drives the feed supply pump 5. A transformer Tr is provided in the circuit and a water level relay switch WLS closes the circuit when the water level is boiler 8 is down to the lower level LL and opens the circuit when the water level in the boiler 8 is at the higher level HL. As will be noted from FIG. 5, the circuit also includes a rectifier Rf and a relay X.

While specific embodiments of the invention have been shown and described in detail to illustrate the application of the inventive principles, it will be understood that the invention may be embodied otherwise without departing from such principles.

What is claimed is:

1. A condensate recovery system for steam apparatus including feed water means and boiler means comprising:

condensate receiver means;

feed water input means for introducing pressurized make-up water from said feed water means into said condensate receiver means;

output passage means conveying water from said condensate receiver means into said boiler means;

condensate sub-receiver means located above said condensate receiver means receiving condensate formed in said steam apparatus;

condensate passage means for conveying condensate from said condensate sub-receiver means into said condensate receiver means;

inlet valve means and outlet valve means operating to open during said first operating phase and to close during said second operating phase said feed water input means and said output passage means;

condensate valve means for closing said condensate passage means during said first operating phase and for opening said condensate passage means during said second operating phase;

discharge passage means for discharging excess low temperature water from said condensate receiver means during said second operating phase, said discharge passage means including an intermediate part thereof located above a point at which said condensate passage means is placed in flow communication with said condensate receiver means;

discharge valve means operating to close said discharge passage means during said first operating phase and to open said discharge passage means during said second operating phase; and equalizer passage means connected with said discharge passage means at said intermediate part thereof at a point downstream of said discharge valve means extending therefrom in communication with a steam portion of said condensate sub-receiver; whereby said recovery system is arranged to operate with alternately repeated first and second operating phases, said second operating phase including introducing condensate accumulated in said sub-receiver means into said receiver means leaving said receiver means filled with water, and at the same time discharging residual low temperature make-up water in said condensate receiver means and holding hot water therein, said first operating phase including pumping into said boiler hot water that is accumulated during said second phase by pumping make-up water into said condensate receiver.

2. A condensate recovery system for steam apparatus including feed water means and boiler means comprising:

condensate receiver means;

feed water input means for delivering feed water from said feed water means into said condensate receiver means;

output passage means for conveying water from said condensate receiver means into said boiler means;

condensate sub-receiver means located above said condensate receiver means and connected to receive condensate formed in said steam apparatus;

condensate passage means conveying condensate from said condensate sub-receiver means into said condensate receiver means;

discharge passage means for discharging water from said condensate receiver means to said feed water means;

said discharge passage means including an intermediate portion thereof located at a level above the level at which said condensate passage means is connected in flow communication with said condensate receiver means;

condensate passage check valve means for preventing back flow of condensate from said condensate receiver means to said condensate sub-receiver means;

boiler level detector means for providing a signal indicative of the fluid level in said boiler means, said boiler level detector means being connected to activate said feed water means to effect pumping of water into said condensate receiver means when the level in said boiler means falls below a predetermined lower level;

discharge passage control valve means responsive to said boiler level detector means for opening and closing said discharge passage means, said discharge passage control valve means operating to close said discharge passage means when said boiler level detector means energizes said feed water means to pump water into said condensate receiver means; and equalizer passage means connected with said discharge passage means at said intermediate part thereof at a point downstream of said discharge passage control valve means, said equalizer passage means extending into communication with said condensate sub-receiver means.

3. A condensate recovery system according to claim 2 further comprising check valve means in said feed water means for preventing back flow of feed water from said condensate receiver means.

4. A condensate recovery system according to claim 2 further comprising check valve means in said output passage means for preventing back flow of water from said boiler means.

5. A condensate recovery system according to claim 2 wherein said discharge passage means include a mixing chamber locate at a point downstream of said discharge passage control valve means.

6. A condensate recovery system according to claim 2 further comprising perforated plate means within said condensate receiver means.

7. A condensate recovery system according to claim 6 wherein said condensate receiver means is formed with an upper and a lower portion and wherein said perforated plate means include a first perforated plate extending across said condensate receiver means at said lower portion and a second perforated plate extending across said condensate receiver means at said upper portion, said second perforated plate being located below the point in said condensate receiver means where said condensate passage means is placed in flow communication therewith.

8. A condensate recovery system according to claim 2 further comprising an annular cooling chamber extending about said condensate sub-receiver means and connected as part of the flow path of said feed water means.

9. A condensate recovery system according to claim 7 wherein said first perforated plate is located in said condensate receiver means at a point above the point at which said discharge passage means is connected in flow communication with said condensate receiver means.

10. A condensate recovery system according to claim 2 wherein condensate from said condensate sub-receiver means flow through said condensate passage means into said condensate receiver means by force of gravity.

11. A condensate recovery system according to claim 2 wherein said discharge passage means include primary pressure control valve means set to open at a predetermined pressure and connected in said discharge passage means downstream of said point of conjunction between said discharge passage means and said equalizer passage means.

* * * * *